US007302727B2

(12) United States Patent
Azmoun et al.

(10) Patent No.: US 7,302,727 B2
(45) Date of Patent: Dec. 4, 2007

(54) PRESSED POWDER PAN CLEANING MACHINE

(75) Inventors: Ali Azmoun, Sea Cliff, NY (US); Andrew C. Smith, Forest Hills, NY (US)

(73) Assignee: E-L Management Corporation, New York, NY (US)

( * ) Notice: Subject to any disclaimer, the term of this patent is extended or adjusted under 35 U.S.C. 154(b) by 729 days.

(21) Appl. No.: 10/827,746

(22) Filed: Apr. 19, 2004

(65) Prior Publication Data

US 2005/0229353 A1 Oct. 20, 2005

(51) Int. Cl.
*A47L 7/00* (2006.01)

(52) U.S. Cl. ..... 15/74; 15/77; 15/88.1; 15/88.3; 15/101; 15/308

(58) Field of Classification Search ..... 15/74, 15/77, 88.1–88.3, 101, 102, 306.1, 307, 308, 15/309.2

See application file for complete search history.

(56) References Cited

U.S. PATENT DOCUMENTS 3,939,514 A * 2/1976 Cook ..... 15/88.2
5,477,584 A * 12/1995 Thumm ..... 15/302
6,092,253 A * 7/2000 Moinpour et al. ..... 15/77
6,543,079 B1 4/2003 Yeo
6,625,836 B1 * 9/2003 Lee ..... 15/77

* cited by examiner

*Primary Examiner*—Theresa T. Snider
(74) *Attorney, Agent, or Firm*—Martin W. Haerter

(57) ABSTRACT

An apparatus is provided for cleaning residual powder and other contaminants from external surfaces of pressed powder cosmetic pans before the pans are adhered into the compact. A feed chute feeds pans into a feed path in the apparatus one after another in an upright orientation. The feed path includes two cleaning stations, each provided with brushes for scrubbing the pan. One cleaning station has cylindrical or drum brushes to scrub the bottom of each pan. The other cleaning station has a belt-type brush to scrub the sides of each pan. Dust collection systems are suspended above and below the apparatus at appropriate locations along the feed path to collect the residual powder and contaminants removed from the pans. Belts may be provided within the feed path to move the pans through the cleaning stations.

32 Claims, 6 Drawing Sheets

PRESSED POWDER PAN CLEANING MACHINE

BACKGROUND OF THE INVENTION

1. Field of the Invention

This invention relates to an apparatus for cleaning articles of manufacture. In particular, it relates to an apparatus for cleaning residual powder from the side and bottom external surfaces of a pressed powder pan after the pan has been filled and pressed, and prior to installing the pan in a cosmetic compact.

2. Description of the Prior Art

Cosmetic powder make-up, such as, for example, blush, is often provided to consumers in a 'pressed powder' form. Pressed powder is loose powder that has been compacted under pressure into a cake-like block. Preferably, the cosmetic is formulated such that the resulting pressed powder cake releases cosmetic with relative ease when a user wipes a surface of the cake. A pressed powder cake formulated to release cosmetic readily may be relatively fragile and may crumble with relative ease if not properly supported. For this reason, pressed powder cosmetics are generally provided in a shallow metal or plastic pan (reference number 4 in FIGS. 5 and 6). The pan 4 defines the shape and size of the pressed powder cake 7 during manufacture, and maintains the integrity of the cake during assembly of the cake into a cosmetic compact package, e.g., a plastic clamshell case 15 dimensioned to receive the cosmetic filled pan. The pan further maintains the integrity of the cake during storage and transport, and ultimately during use by the consumer.

To manufacture a pressed powder cosmetic compact, loose powder is first filled into a metal pan. The loose powder is compressed under high pressure in the pan to form a cake 7. The finished cosmetic pressed pan is assembled into a cosmetic compact case 15, e.g., a plastic clamshell case. The cosmetic filled pan may be secured in the compact by adhering an exterior surface or surfaces of the pan to a surface or surfaces of the compact case.

A problem common to the production of pressed powder compacts stems from the accumulation of residual powder and/or other contaminants on the exterior side and/or bottom surfaces of the pan. Residual powder may be any cosmetic powder not properly pressed into cake form, including pigments, binders, solvents or other ingredients or components of the cosmetic. Other contaminants include, but are not limited to, process contaminants (e.g., oil, grease or solvents from the process machinery), dust, dirt or moisture from external sources. To ensure proper adhesion of the pan to the cosmetic case, the residual powder and other contaminants must be removed from the exterior surfaces of the pan prior to adhering the pan in a compact case. The cleaning of exterior surfaces of pressed powder pans has heretofore been accomplished by manual labor. It will be appreciated that manual labor for such a process can be costly, time consuming, inefficient and inconsistent. In cases where the residual powder is not properly removed from the exterior surfaces of the pan prior to adhesion to the compact case, an inferior product may result with a pressed powder pan that can prematurely separate from the compact case.

Accordingly, there is a need for a machine that can automate the cleaning of side and/or bottom exterior surfaces of pressed powder pans after the pans have been filled.

BRIEF SUMMARY OF THE INVENTION

To overcome the process and product quality deficiencies of the prior art pressed powder compact assemblies, an apparatus is provided for cleaning residual powder and other contaminants from external surfaces of the pressed powder pans before they are adhered into the compact. A feed chute feeds pans into a feed path in the apparatus one after another in an upright orientation. The feed path has dimensions slightly larger than the height and width of the pans. The feed path includes two cleaning stations, each provided with brushes for scrubbing the pan. One cleaning station has cylindrical or drum brushes to scrub the bottom of each pan. The other cleaning station has a belt-type brush to scrub the sides of each pan. Dust collection systems are suspended above and below the apparatus at appropriate locations along the feed path to collect the residual powder and contaminants removed from the pans.

DETAILED DESCRIPTION OF THE INVENTION

Figure 5:
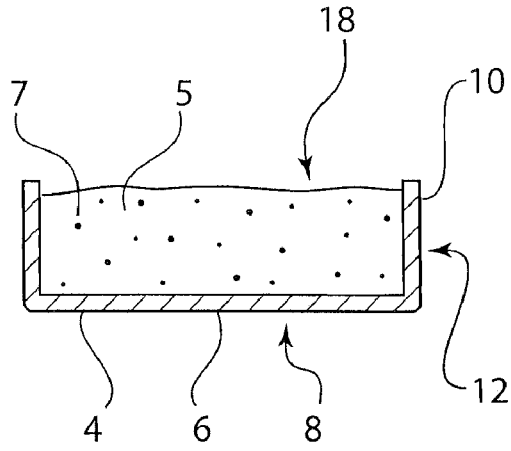
FIG. 5 is a sectional elevation view of a pressed powder pan.
Figure 6:
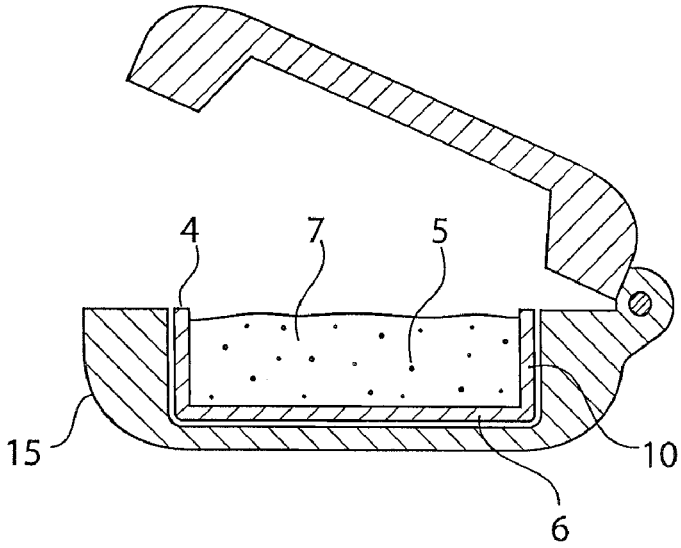
FIG. 6 is a sectional elevation view of a pressed powder pan installed in a clamshell compact case.
Figure 7:
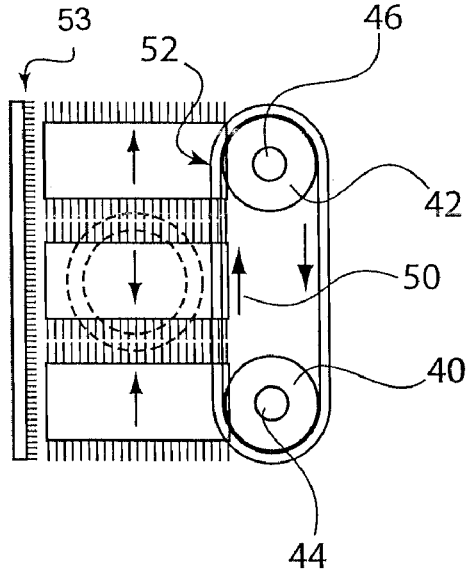
FIG. 7 is a detail top view of the side cleaning station.

A pan cleaning apparatus, indicated generally by reference number 2 in the Figures, is provided for cleaning residual powder from a pan 4 containing cosmetic 5 in the form of a pressed powder cake 7. Referring to FIGS. 5 and 6, each pan 4 has a bottom 6 with an exterior surface 8 and a side 10 with an exterior surface 12. The side 10 defines an open top end 18. The pans 4 are generally shallow, i.e., substantially wider than they are deep. When viewed from above, the pans 4 are generally round in plan view, but may be provided in any desired shape, e.g., square, rectangular, oval, triangular, or other suitable shape. The pans generally are made from metal or plastic.

Figure 1:
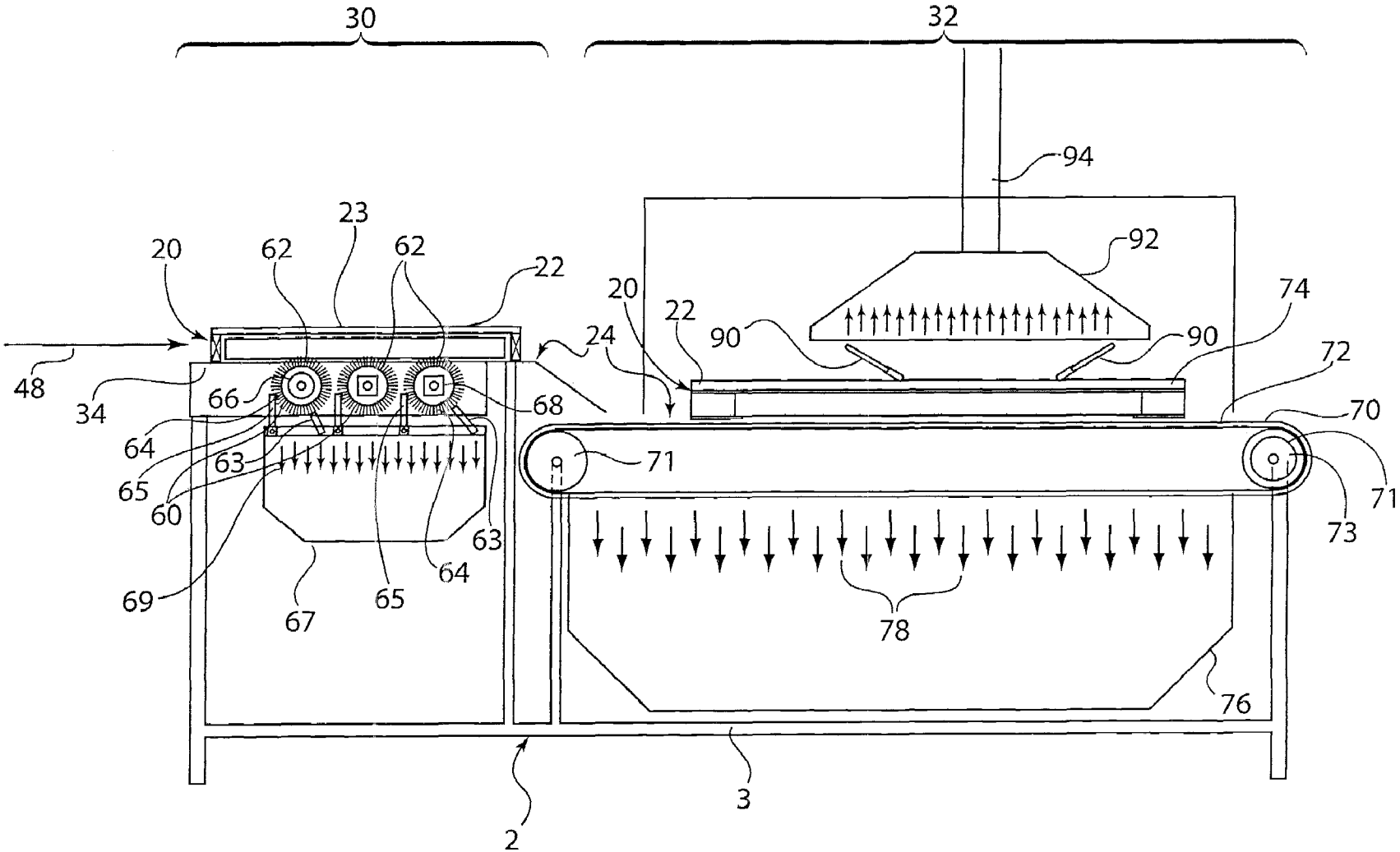
FIG. 1 is a side elevation view of the apparatus.
Figure 2:
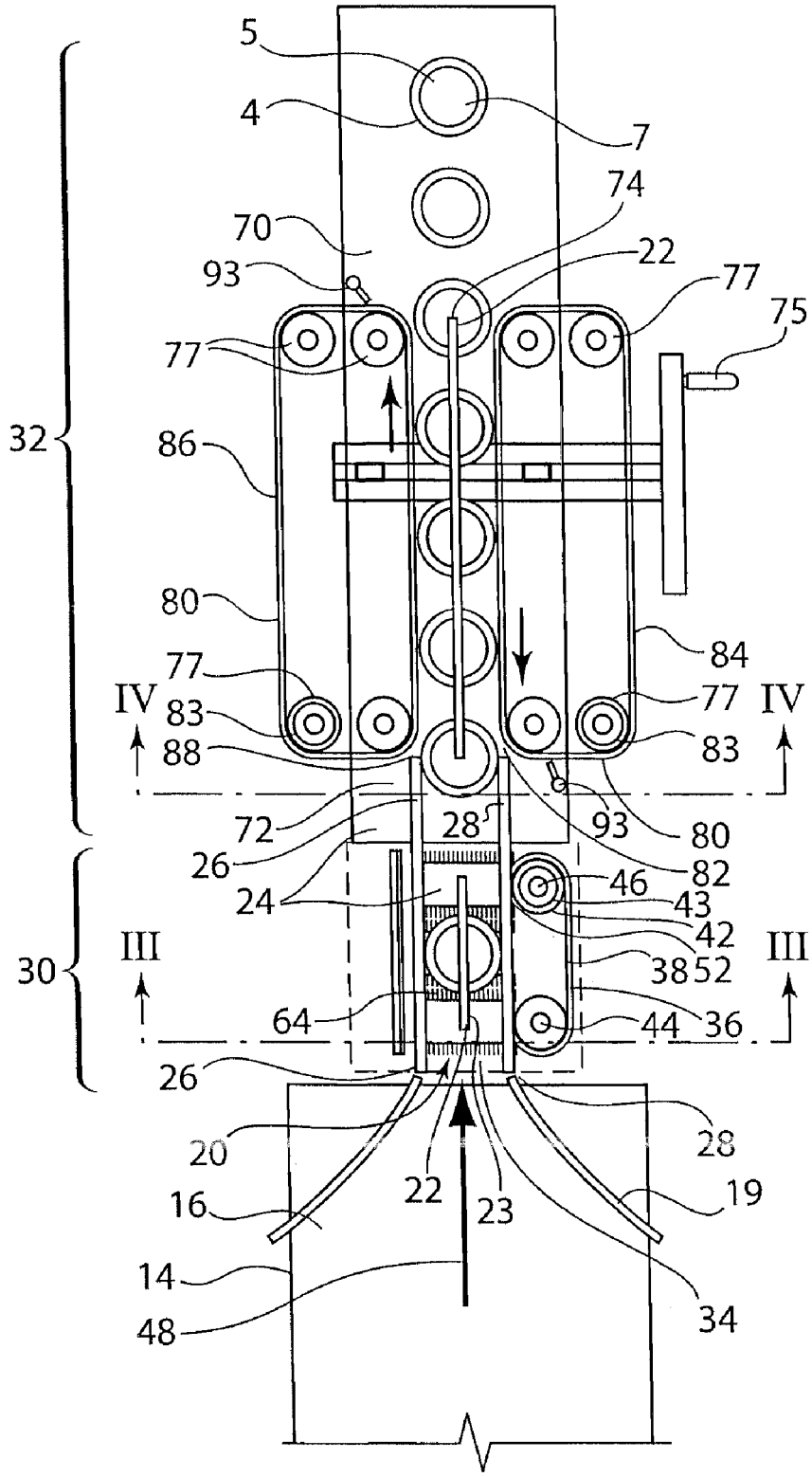
FIG. 2 is a top plan view of the apparatus.
Figure 4:
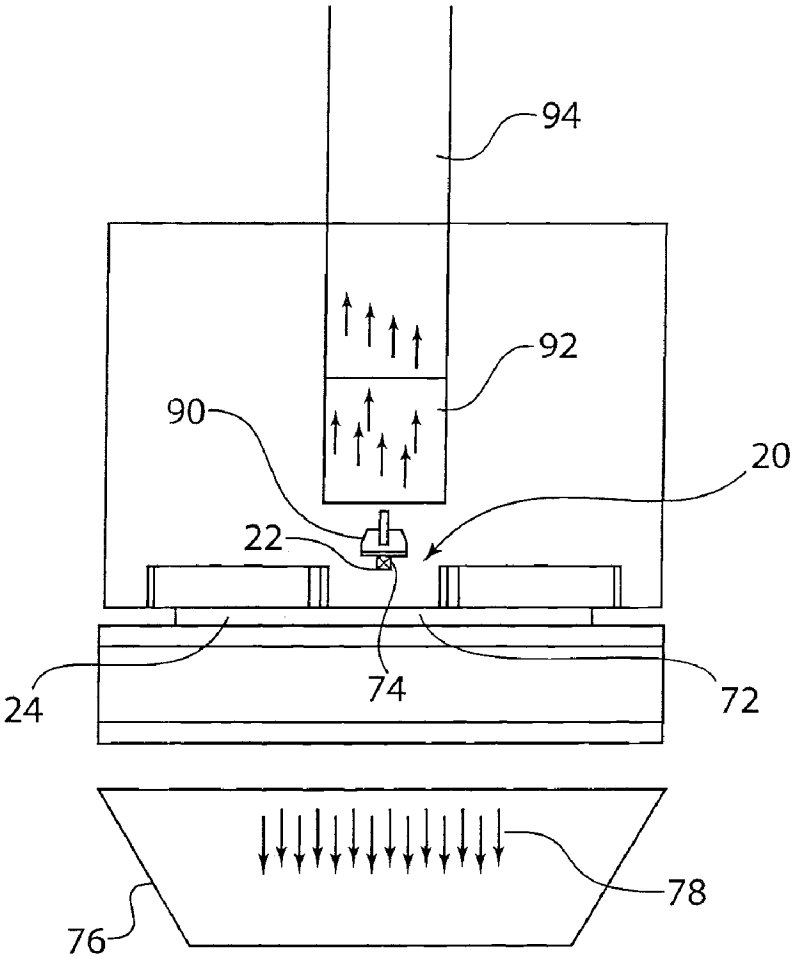
FIG. 4 is a sectional view of the top cleaning station taken along line 4-4 in FIG. 2.
Figure 3:
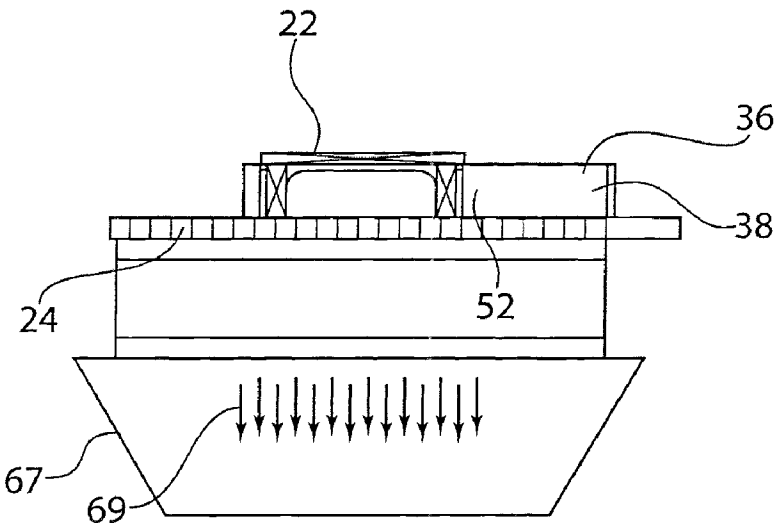
FIG. 3 is a sectional view of the side cleaning station taken along line 3-3 in FIG. 2.

Feed means 14 adjacent to the apparatus 2 are adapted to feed the pans 4 one after another in an upright orientation into the apparatus. The feed means 14 may take the form of an input conveyor belt 16, shown in part in FIG. 2, which feeds pans successively into the apparatus. The input conveyor 16 is made of a suitable natural or synthetic rubber or elastomer material moving at a rate of approximately 5-30 fpm (feet per minute). The portion of input conveyor belt 16 shown in FIG. 2 may represent the output end of the pan-filling production apparatus. Thus, the filling and cleaning operations may be performed on adjacent apparatus in close proximity to one another, such that the pan-filling apparatus feeds filled pans into the pan cleaning apparatus. However, the proximal arrangement of the two operations, though convenient, is not essential to the function of the cleaning apparatus, which may be independent of the filling operation. For example, the filling operation could be performed at one manufacturing site while the cleaning operation is performed at another. As an alternative to the input conveyor belt 16, the feed means could be a ramp (not shown) with sufficient slope to permit the pans 4 to slide into the pan cleaning apparatus. The term "upright orientation" as used herein with reference to the pans 4 means that the pans are in a normal, substantially level orientation, with the closed bottom directed downwardly, and the open top directed upwardly. A funnel shaped chute 19 may be provided to guides the pans into the apparatus 2 in a single file, i.e., one after another.

The pan cleaning apparatus 2 includes two cleaning stations 30, 32 mounted on a base 3. The pans are fed into a feed path, shown generally at 20, that extends through the apparatus 2, i.e. the feed path 20 extends through both cleaning stations 30, 32. The feed path 20 has a height defined between a top member 22 and a pan supporting structure 24. The top member 22 may be a continuous rail or top wall extending through both cleaning stations. Alternatively, as described in greater detail below, the top member may comprise a first section in the first cleaning station and a second section in the second cleaning station. A width of the feed path 20 is defined between two spaced apart side walls 26, 28. The top member 22, pan supporting structure 24 and side walls 26, 28 are all ultimately supported on base 3. The height and width of the feed path 20 closely approximate corresponding height and width dimensions of the pans 4 with sufficient clearance to permit the pans to move freely through the feed path one after another. For example, it has been found that a clearance of 1 to 2 mm between the top member 22 and the top edge of the pans permits transport of the pans with little or no drag or friction, while ensuring that adjacent pans do not over-ride each other. The height and width of the feed path are of course adjustable to accommodate pans of varying dimensions. For example, a crank 75 is provided for adjusting the width of the feed path in the second cleaning station. Manipulation of the crank 75 moves one or both of the sides (in this portion defined by belts 84 and 86) of the feed path relative to the other to adjust the width of the feed path.

A first cleaning station 30 defines a first portion of the feed path and receives the pans 4 from the feed means 14. A second cleaning station 32 defines a second portion of the feed path and receives the pans 4 from the first cleaning station 30. One of the first and second cleaning stations is adapted to clean the external surface 8 of the bottom 6 of the pans 4. The other of the first and second cleaning stations is adapted to clean the external surface 12 of the side 10 of the pans 4. In the Figures, for example, the first cleaning station 30 is illustrated as being adapted to clean the external surface 8 of the bottom 6 of pan 4 while the second cleaning station 32 is illustrated as adapted to clean the external surface 12 of side 10. While for clarity the description that follows recites the illustrated arrangement, it will be understood that the opposite arrangement is also possible, i.e., a first cleaning station adapted to clean the side of the pan and a second cleaning station adapted to clean the bottom of the pan.

The cleaning station 30 has a horizontal platform 34 forming at least part of the pan supporting structure 24 that defines the lower limit of the feed path 20. The top member 22 is a top rail 23, spaced above and parallel to the platform 34, to define the upper limit of the feed path through the cleaning station 30. The top rail 23 provides down pressure on the pans 4 as the pan bottoms are cleaned. The top rail 23 may be adjustable relative to the platform, and/or the platform may be adjustable relative to the top rail, to increase or decrease the height of the feed path to accommodate pans 4 of various height dimensions, and/or to adjust the amount of down pressure on the pans. The platform 34 is broad enough to support the full width of the pans 4. The side walls 26, 28 defining the width of the feed path through the first cleaning station are suspended just above the platform 34, and below and parallel to the top rail. At least one of the side walls 26, 28 is adjustable with respect to the other such that the width of the feed path can be increased or decreased to accommodate pans 4 of various widths. Except as otherwise noted herein, the platform 34, top member 22, including top rail 23 and side walls 26 and 28 are made of a suitable metal or plastic material, such as, for example, aluminum, high polish stainless steel, nylon, high density polyethylene, or combinations thereof. In particular, the top member 22 is preferably made of high polish stainless steel to minimize drag or friction, and to minimize damage that could result to softer materials from contact with the sharp, sheet metal edges of the pressed powder pans as they pass through the feed path.

First transport means 36 are provided along at least one of the sidewalls 26, 28 in cleaning station 30 for moving each of the pans along the feed path. In the illustrated apparatus, first transport means 36 is an "in-feed" belt 38 running along side wall 28. The in-feed belt 38 is supported on and rotates about wheels 40, 42 mounted on vertical axes 44, 46, respectively, adjacent to side wall 28. At least one of the wheels is driven by, for example, a motor 43 (represented schematically), preferably with variable frequency drive ("vfd") controls (the combined motor and vfd controls will hereinafter be referred to as a "vfd motor") to selectively permit adjustments in speed and direction of rotation. Thus, the in-feed belt 38 forms a moving vertical surface portion 52 corresponding to a portion of side wall 28 within the feed path 20. The portion 52 of the in-feed belt within the feed path moves in the feed direction (indicated by arrow 48,50) at a speed of approximately 5-30 fpm (feet per minute). Preferrably, the speed is selectively adjustable by manipulating the vfd controls to accommodate varying soiling conditions or types of residual powder, etc. The portion 52 is adapted to contact the side 10 of pans 4 with sufficient traction to propel the pans 4 along the feed path 20 in the feed direction at a speed slightly less than the speed of the belt due in part to resistance that the pans encounter from the cleaning process and in part due to rotation of the pans as they travel through the feed path. The belt 38 is made from a natural or synthetic rubber or other suitable elastomer material, with the material and contact surface selected to provide the required traction. The distance between axes 44 and 46 is approximately 8 inches, but may be any length suitable to propel the pans 4 through the entire length of the cleaning station 30. The belt 38 rotates at a speed of sufficient to move the pans in the feed direction at a speed of appoximately 5-30 fpm. The opposite side wall 26 may be provided with a "fixed" or stationary brush 53 (i.e., not rotatable or movable). The stationary brush 53 effects some degree of cleaning of the side of each pan and facilitates rotation of each pan as each pan passes over the bottom cleaning brushes.

The first cleaning station as illustrated is adapted to clean the external surface 8 of the bottom 6 of the pans 4 with bottom scrubbing means 60 that project upwardly through at least one clearance 62 in the platform 34. In the illustrated apparatus 2, the bottom scrubbing means 60 take the form of three rotating radial or cylindrical brushes 64, each with bristle tips projecting through a corresponding clearance 62 in the platform 34. The bristle tips of each brush 64 project sufficiently through the clearance 62 into the feed path to contact and scrub the bottom surface of each of the pans successively as the pans move along the feed path. Each of the brushes 64 are rotated by drive means 66 (represented schematically on one brush) in the form of a vfd motor. The vfd motor 66 may be connected directly to a brush 64, or linked indirectly by way of a belt, shaft, chain, gears or other linkage means. Each individual brush may be provided with a vfd motor (not shown). Preferably, for economy and space reasons, one vfd motor 66 drives all three brushes by, for example, a direct connection to one brush and gearboxes 68 (represented schematically) that are linked to the other brushes such that the speed and direction of rotation of each of the brushes is independently variable. Thus, each of the three brushes 64 may be rotated relatively independently from the others such that each may rotate at a different speed in the range of 1 to 200 rpm (revolutions per minute). At least one of the brushes preferably rotates at a speed of approximately 125 rpm. Furthermore, each of the brushes may be rotated in a direction independent of the others. Preferrably, at least one brush is rotated in a direction opposite the other two. The brushes 64 may have natural or synthetic bristles with a density and stiffness suitable for removing cosmetic residue from the surfaces of the pans. A suitable brush for this application, for example, is manufactured by Roller Brushes Inc. (part no. 34N1405203).

As the brushes 64 rotate and bristle tips contact the bottoms of pans 4, residual powder and other contaminants or waste are removed from the bottom of the pans. The powder, contaminants and waste removed from the pans may accumulate in the brushes 64. Accordingly, a scraper 65 is provided below each of the brushes 64 with an edge projecting into the bristles of the respective brush. The scraper 65 associated with each brush facilitates removal of residual powder, contaminants and waste from that brush as it rotates. Additionally, an air jet 63 may be provided adjacent to the scraper 65 to direct a stream of pressurized air into the brush 64 to further remove residual powder, contaminants and waste from the brush. The pressurized air may be ionized to prevent static electricity from causing clumping or clustering of residual powder, contaminants and waste particles, thus facilitating removal and collection. The residual powder, contaminants and waste removed from each brush by the respective scraper and air jet falls in the direction indicated by arrows 69 into a collection tray 67 mounted below the brushes, scrapers and jets, where it is collected for disposal.

Cleaning station 32 has second transport means 70 in the form of a conveyor belt 72 supported on rollers 71 mounted on the base 3. The conveyor belt 72 forms at least part of the pan supporting structure 24 that defines the lower limit of the feed path 20. Conveyor belt 72 supports the pans as they are transported through the portion of the feed path in cleaning station 32. Drive means 73 (represented schematically) in the form of a vfd motor cause conveyor belt 72 to move at approximately 60 fpm (feet per minute) in the feed direction (indicated by arrow 48). Thus, conveyor 72 also serves to move each of the pans 4 along the portion of the feed path 20 in cleaning station 32. The top member 22 is in the form of a top rail 74. As noted above, the top member 22 is preferably a high polish stainless steel to minimize friction and avoid damage from the sharp edges of the metal pans. The conveyor belt 72 should be sufficiently broad to accommodate pans up to substantial widths. A suitable conveyor belt is a ribbed black rubber belt, such as one available, for example, from Haberset company (model no. NSL-10ELA). Side walls 26, 28 which continue from cleaning station 30 into and through cleaning station 32, are suspended just above conveyor belt 72. At least one of the side walls 26, 28 is adjustable with respect to the other such that the width of the feed path over the conveyor can be increased or decreased to accommodate pans 4 of various widths. With the side walls suspended above the conveyor belt 72, the feed path width is adjustable while the conveyor belt 72 moves freely beneath the suspended side walls.

The second cleaning station 32 as illustrated is adapted to clean the external surface 12 of the side 10 of the pans 4 with side scrubbing means 80 that project laterally through a clearance 82 in at least one of the side walls (illustrated as side wall 28). The side scrubbing means 80 project sufficiently into the feed path 20 to contact and scrub the external surface 12 of the side of each of the pans successively as the pans move along the feed path. In the illustrated apparatus 2, the side scrubbing means 80 is in the form of a belt-type brush 84 suspended just above the conveyor belt 72 on two or more wheels 77 such that the working surface of brush 84 is substantially perpendicular to the horizontal conveyor belt 72. In addition, within the feed path 20, the brush 84 follows a track just within the width of the feed path, with bristle tips projecting into the feed path sufficiently to contact and scrub the side surface of each of the pans successively as the pans move along the feed path. The brush 84 is rotated at a speed of approximately 10-80 fpm by drive means 83(represented schematically) in the form of a vfd motor rotating at least one of the wheels 77. The speed of rotation and direction of rotation of the brush 84 is variable. A suitable brush belt is available from McMaster Carr company (part no. 9003K117).

The side of the feed path 20 opposite brush 84 may be defined by a continuation or an extension of side wall 26. Alternatively the side of the feed path opposite brush 84 may be defined by a second belt-type brush 86 extending through a clearance 88 in side wall 26. The second brush 86 comprises part of the side scrubbing means 80, and is mounted and driven like the first belt brush 84. The second brush 86 is mounted on at least two wheels 77, at least one of which is rotated by drive means 83 (represented schematically) in the form of a vfd motor. The speed and direction of the belt brush 86 is variable. Belt brush 86 may be rotated in a direction or at a speed similar to or different from belt brush 84. Scrapers 93 may be provided adjacent to and in contact with the belt brushes 84 and 86 to facilitate removal of residual powder, contaminents and waste from the brushes.

At least one air knife 90 and a dust collection hood 92 are supported on the base 3 and mounted above the conveyor belt 72. By way of a vacuum hose 94 attached to the dust collection hood, a vacuum is provided within a portion of the feed path 20 immediately below the hood. An output of the air knife is directed down into that portion of the feed path below the hood 92. The output from the air knife lifts loose particles of residual powder, contaminants or waste from within the feed path and the vacuum of the dust collection hood draws the particles from the feed path. From the hood, the particles are drawn into the vacuum hose 94 for collection and subsequent disposal. A second collection tray 76 may be suspended below the conveyor belt 72 to collect for disposal particles of cosmetic residue, waste and soil falling from the belt in the direction of arrows 78.

In the embodiment described above, the two cleaning stations 30 and 32 are arranged in series, i.e., one after the other. It will be understood that the order is not important. In other words, the station 30 cleaning the sides of pans may come before or after the station 32 cleaning the bottoms of the pans.

Figure 8:
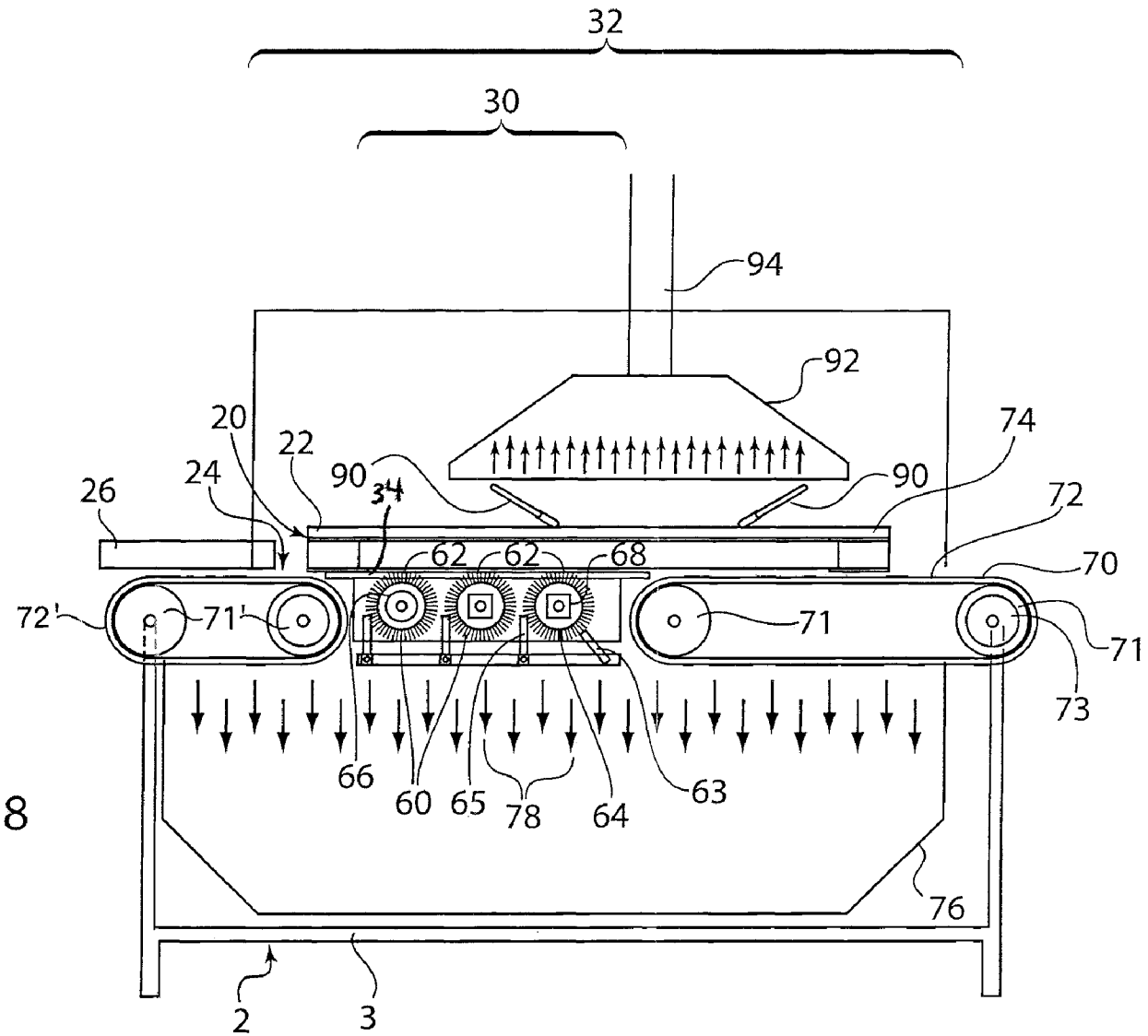
FIGS. 8-9 are views of a second embodiment of the apparatus.
Figure 9:
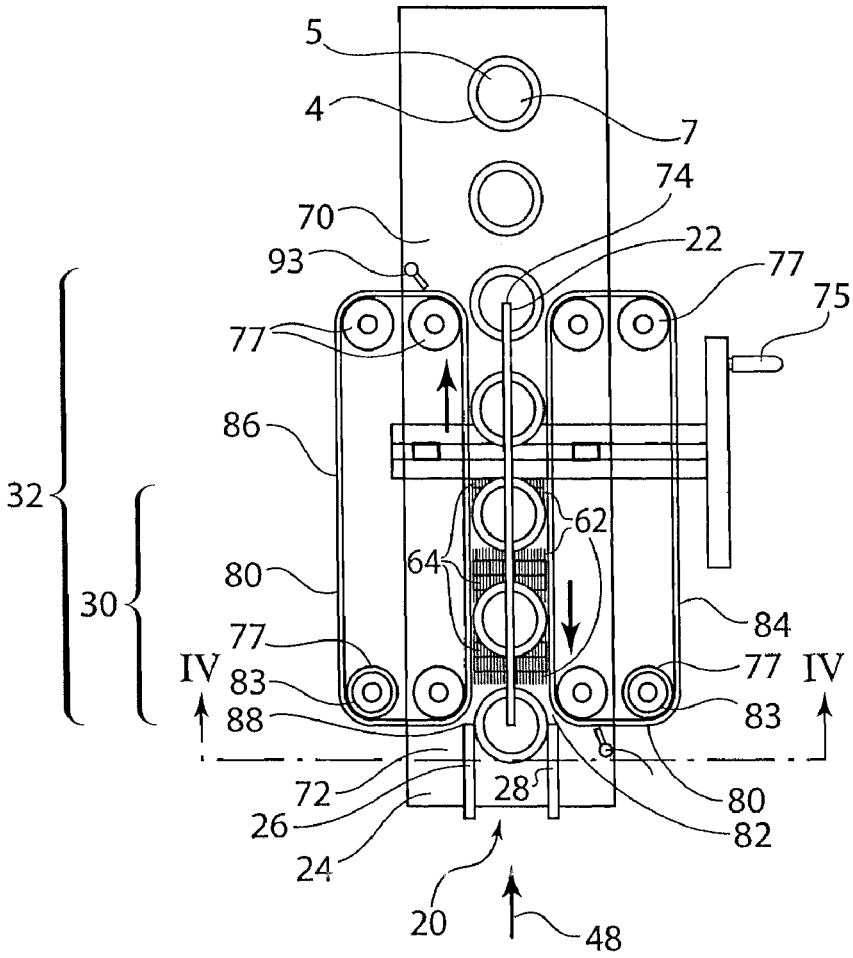

A second embodiment of the pan cleaning apparatus is shown in FIGS. 8-9, wherein the same reference numbers indicate components that are the same as those in the first embodiment. In the second embodiment, the two cleaning stations 30 and 32 may overlap in whole or in part. As described above with respect to the first embodiment, the apparatus 2 of the second embodiment is for cleaning a bottom exterior surface and a side exterior surface of pans containing pressed powder cosmetic. In the second embodiment, the apparatus 2 comprises a feed path 20 extending through the apparatus. The feed path has a height defined between a top member 22 (top rail 74) and a pan supporting structure 24. A width of the feed path 20 is defined between two spaced apart side walls 26, 28. The height and width closely approximate corresponding dimensions of the pans but are large enough to permit the pans to move freely through the feed path one after another. In station 30, bottom scrubbing means 60 (e.g., brushes 64) projecting upwardly through corresponding clearances 62 in the pan supporting structure 24. The means 60 (brushes 64) project sufficiently into the feed path 20 to contact and scrub the bottom exterior surface 8 of each of the pans 4 successively as the pans move along the feed path. Station 32, which in this embodiment fully overlaps station 30, has side scrubbing means 80 (at least one belt-type brush 84, 86) projecting laterally through a clearance 82, 88 in at least one of the side walls 26,28. The side scrubbing means 80 project sufficiently into the feed path 20 to contact and scrub the side surface 12 of each of the pans 4 successively as the pans move along the feed path. The pan supporting structure 24 through the feed path 20 comprises a first conveyor belt 72' supported on rollers 71', horizontal platform 34 (with clearances 62 for brushes 64) and a second conveyor belt 72 supported on rollers 71. An advantage of the overlapping arrangement of the two cleaning stations is that the overall dimensions (particularly the length of the feed path) of the machine can be substantially reduced. Another significant advantage of the overlapping cleaning stations is that the bottom cleaning means and the side cleaning means can be adjusted such that the cleaning means move the pans along the feed path 20, thus eliminating the need for an in-feed belt (although not shown, an in-feed belt could be substituted for belt-type brush 84 or 86) or conveyor belts. In the case of the side cleaning means, this can be accomplished, for example, by adjusting the speed of the belt-type brush (e.g., 86) that travels in the feed direction (arrow 48) within the feed path to be greater than the speed of the belt-type brush (e.g., 84) driven in the opposite direction in the feed path. When properly selected, the speed differential will cause the pans 4 to travel in the feed direction. Similarly, with respect to the bottom cleaning means, the direction of rotation and speed of each of the brushes 64 may be selected such that the combined rotation and speed of the three brushes tends to move the pans 4 in the feed direction. By overlapping the two cleaning stations 30, 32 and selecting the speed and direction of the bottom and side cleaning means to bias movement of the pans in the feed direction, it is contemplated that the pans could be moved through the entire length of the feed path solely by the bottom and side cleaning means, without the need to provide either conveyors or an in-feed belt.

Wherever brushes are illustrated and described in the present invention, substitute scrubbing means may be used. For example, while the scrubbing means 60 is illustrated as one or more radial or cylindrical brushes 64, it will be understood that other types of brushes or scouring pads would also be suitable for cleaning the external surfaces of the pans. For example, a suitable radial, disc, cup, belt or block type brush or pad could be substituted for the illustrated brushes. Radial brushes include any with bristles extending radially from a core, such as, for example, a wheel or cylinder with bristles secured to the core by, for example, in-molding, stapling, adhering, friction fit (in predrilled holes or trapped in a twisted wire core) or captured in a strip/coil wound around the core. A radial scouring pad may have a cylindrical core with scouring material secured about the core. A disc has bristles or scouring material extending perpendicularly from the broad surface of a disc-like base. A cup has bristles or scouring material extending from the rim of a cup-like base. A belt brush has bristles extending perpendicularly from a belt. A belt scouring pad generally has scouring material secured to a belt backing. A block brush or pad has bristles or scouring material secured to one or more surfaces of a block. The radial or cylindrical brush or pad would be arranged to rotate as illustrated. The disc or cup could be adapted to rotate such that the bristles or scouring material would contact the surface of each passing pan. The block brush or block pad could be provided with with reciprocating movement to effect scrubbing of the pans. The brushes may be provided with bristles made of a natural fiber (e.g., hog bristle) or synthetic fiber (e.g., nylon or elastomer). The preferred material for scouring pads is a synthetic non-woven web, such as, for example, nylon. The bristles or scouring material may be provided with enhancing features, such as, for example, abrasive material to facilitate the scrubbing function.

After each pan 4 has passed through both cleaning stations, the pan is carried out of the pan cleaning apparatus 2. At this point, the cleaned cosmetic filled pan 4 is ready for assembly into a cosmetic compact case 15, e.g., a plastic clamshell case (see FIG. 6). The cosmetic filled pan 4 may be secured in the compact 15 by adhering a bottom or side exterior surface or surfaces (8 and 12, respectively) of the pan to an interior surface or surfaces of the compact case 15.

The automated apparatus described herein has the advantage of providing consistent and uniform removal of residual powder from exterior surfaces of pressed powder pans, thus improving subsequent adhesion of each of the pans to a clamshell compact case. Another advantage is that the machine substantially eliminates manual labor and the injuries (e.g., repetitive motion injuries such as carpal tunnel injuries) associated therewith. Because manual labor is eliminated, and the machine can be completely enclosed and contained in a controlled environment, worker comfort, health and safety are improved by eliminating exposure to dust and contaminents. The apparatus also speeds up the process of manufacturing cosmetic compact cases containing pressed powder, and increases the quality and durability of the cases made. For example, round metal pans approximately 50 mm in diameter can be cleaned at a rate of approximately 17-20 pieces per minute.

While the invention has been described and illustrated as embodied in preferred forms of construction, it will be understood that various modifications may be made in the structure and arrangement of the parts without departing from the spirit and the scope of the invention recited in the following claims.

What is claimed is:

1. An apparatus for cleaning residual powder from pans containing pressed powder cosmetic, each of the pans having a bottom exterior surface and a side exterior surface, the apparatus comprising:

a feed path extending through the apparatus, the feed path having a height defined between a top member and a pan supporting structure, and a width defined between two spaced apart side walls, the height and width closely approximating corresponding dimensions of one of the pans but large enough to permit the pans to move freely through the feed path one after another;

a first cleaning station defining a first portion of the feed path, the first cleaning station receiving the pans from means for successfully feeding the pans; and a second cleaning station defining a second portion of the feed path, the second cleaning station receiving the pans from the first cleaning station; wherein one of the first cleaning station and the second cleaning station comprises:

a platform forming the pan supporting structure;

first transport means for moving each of the pans along the feed path; and bottom scrubbing means projecting upwardly through a clearance in the platform and sufficiently into the feed path to contact and scrub the bottom surface of each of the pans successively as the pans move along the feed path; and the other of the first cleaning station and the second cleaning station comprises:

second transport means for moving each of the pans along the feed path; and side scrubbing means projecting laterally through a clearance in at least one of the side walls, the side scrubbing means projecting sufficiently into the feed path to contact and scrub the side surface of each of the pans successively as the pans move along the feed path.

2. The apparatus of claim 1 wherein at least one of the two spaced apart side walls is moveable relative to the other such that the width of the feed path is adjustable.

3. The apparatus of claim 1 wherein at least one of the top member and the pan supporting structure is movable relative to the other such that the height of the feed path is adjustable.

4. The apparatus of claim 1 wherein the second transport means comprises at least a portion of the pan supporting structure and is a conveyor belt.

5. The apparatus of claim 1 wherein the first transport means further comprises an in-feed belt supported on wheels rotatable about vertical axes adjacent to the feed path, the belt supported such that a portion of the belt forms part of one of the side walls.

6. The apparatus of claim 1 wherein bottom scrubbing means are selected from one of a brush and a scouring pad.

7. The apparatus of claim 6 wherein the brush is selected from one of a radial brush, a disc brush, a belt brush and a block brush.

8. The apparatus of claim 6 wherein the scouring pad is selected from one of a cylindrical pad, a disc pad, a belt pad and a block pad.

9. The apparatus of claim 1 wherein the side scrubbing means are selected from one of a brush and a scouring pad.

10. The apparatus of claim 9 wherein the brush is selected from one of a radial brush, a disc brush, a belt brush and a block brush.

11. The apparatus of claim 9 wherein the scouring pad is selected from one of a cylindrical pad, a disc pad, a belt and a block pad.

12. The apparatus of claim 1 further comprising a stationary brush supported on the side wall opposite the first transport means.

13. The apparatus of claim 1 further comprising an air knife and dust collection hood mounted above the feed path, the dust collection hood providing a vacuum above and within the feed path, and an output of the air knife directed down into the feed path below the hood, such that loose particles are lifted from within the feed path and directed into the vacuum of the dust collection hood.

14. The apparatus of claim 1 further comprising dust collection means suspended below the feed path, the dust collection means adapted to draw loose residual powder from the horizontal scrubbing means.

15. An apparatus for cleaning a bottom exterior surface and a side exterior surface of pans containing pressed powder cosmetic, the apparatus comprising:

a feed path extending through the apparatus, the feed path having a height defined between a top member and a pan supporting structure, and a width defined between two spaced apart side walls, the height and width closely approximating corresponding dimensions of the pans but large enough to permit the pans to move freely through the feed path one after another;

bottom scrubbing means projecting up through a clearance in the pan supporting structure and sufficiently into the feed path to contact and scrub the bottom surface of each of the pans successively as the pans move along the feed path; and side scrubbing means projecting laterally through a clearance in at least one of the side walls, the side scrubbing means projecting sufficiently into the feed path to contact and scrub the side surface of each of the pans successively as the pans move along the feed path.

16. The apparatus of claim 15 wherein at least one of the two spaced apart side walls is moveable relative to the other such that the width of the feed path is adjustable.

17. The apparatus of claim 15 wherein at least one of the top member and the pan supporting structure is movable relative to the other such that the height of the feed path is adjustable.

18. The apparatus of claim 15 wherein at least one of the side walls further comprises first transport means adapted to contact the side exterior surface of the pans to move the pans along at least a portion of the feed path.

19. The apparatus of claim 18 wherein the first transport means includes an in-feed belt supported on wheels rotatable about vertical axes adjacent to the feed path, the belt supported such that a portion of the belt forms part of one of the side walls.

20. The apparatus of claim 18 wherein the side scrubbing means are adapted to act as the first transport means.

21. The apparatus of claim 15 wherein the pan supporting structure further comprises second transport means adapted to contact the bottom exterior surface of the pans to move the pans along at least a portion of the feed path.

22. The apparatus of claim 21 wherein the second transport means includes at least one conveyor belt.

23. The apparatus of claim 21 wherein the bottom scrubbing means are adapted to act as the second transport means.

24. The apparatus of claim 15 wherein the bottom scrubbing means are selected from one of a brush and a scouring pad.

25. The apparatus of claim 24 wherein the brush is selected from one of a radial brush, a disc brush, a belt brush and a block brush.

26. The apparatus of claim 24 wherein the scouring pad is selected from one of a cylindrical pad, a disc pad, a belt pad and a block pad.

27. The apparatus of claim 15 wherein the side scrubbing means are selected from one of a brush and a scouring pad.

28. The apparatus of claim 27 wherein the brush is selected from one of a radial brush, a disc brush, a belt brush and a block brush.

29. The apparatus of claim 27 wherein the scouring pad is selected from one of a cylindrical pad, a disc pad, a belt and a block pad.

30. The apparatus of claim 18 further comprising a stationary brush supported on the side wall opposite the first transport means.

31. The apparatus of claim 15 further comprising an air knife and a dust collection hood mounted above the conveyor belt, the dust collection hood providing a vacuum above and within the feed path, and an output of the air knife directed down into the feed path below the hood, such that loose particles are lifted from within the feed path and directed into the vacuum of the dust collection hood.

32. The apparatus of claim 15 further comprising dust collection means suspended below the feed path, the dust collection means adapted to draw loose residual powder from the feed path and scrubbing means.

* * * * *